US005955846A

United States Patent [19]

Kominami et al.

[11] Patent Number: 5,955,846

[45] **Date of Patent: *Sep. 21, 1999**

[54] DISCHARGE LAMP LIGHTING DEVICE AND A METHOD FOR LIGHTING A DISCHARGE LAMP

[75] Inventors: Satoshi Kominami, Osaka; Kouji Miyazaki, Yawata; Shigeru Horii, Takatsuki, all of Japan

[73] Assignee: Matsushita Electric Industrial Co., Ltd., Kadoma, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/614,095

[22] Filed: Mar. 12, 1996

[30] Foreign Application Priority Data

Mar. 15, 1995 [JP] Japan ..... 7-056019

[51] Int. Cl.[6] ..... H05B 37/02

[52] U.S. Cl. ..... 315/268; 313/594; 313/601; 315/DIG. 7; 315/330; 315/290; 315/335

[58] Field of Search ..... 315/205, DIG. 7, 315/289, 290, 330, 335, 267, 62; 313/581, 594, 601, 602

[56] References Cited

U.S. PATENT DOCUMENTS

| | | | |
|---|---|---|---|
| 2,465,059 | 3/1949 | Campbell | 315/290 |
| 2,480,122 | 8/1949 | Daniels | 313/594 |
| 3,544,840 | 12/1970 | Saiger | 315/205 |
| 4,004,188 | 1/1977 | Cooper | 315/261 |
| 4,272,704 | 6/1981 | Alexander | 315/205 |
| 4,316,122 | 2/1982 | Yamazaki et al. | 313/594 |
| 4,401,912 | 8/1983 | Martzloff et al. . | |
| 5,032,762 | 7/1991 | Spacil et al. . | |
| 5,294,868 | 3/1994 | Jones et al. | 315/205 |
| 5,397,965 | 3/1995 | Gorille . | |
| 5,498,933 | 3/1996 | Nakamura . | |

FOREIGN PATENT DOCUMENTS

| | | |
|---|---|---|
| 0449639 | 10/1991 | European Pat. Off. . |
| 4224996 | 2/1994 | Germany . |
| 4400412 | 7/1994 | Germany . |
| 59-194343 | 11/1984 | Japan . |
| 62-246243 | 10/1987 | Japan . |
| 6203984 | 7/1994 | Japan . |
| 2289160 | 11/1995 | United Kingdom . |
| 9118413 | 11/1991 | WIPO . |
| 9312630 | 6/1993 | WIPO . |

*Primary Examiner*—Michael B. Shingleton
*Attorney, Agent, or Firm*—Renner, Otto, Boisselle & Sklar, P.L.L.

[57] ABSTRACT

A discharge lamp lighting device according to the present invention includes: a discharge lamp including an electrode; and a lighting circuit for lighting the discharge lamp, the lighting circuit being connected to the discharge lamp, wherein the discharge lamp includes a conductor at least partially surrounding the electrode, and the lighting circuit provides a potential for the conductor that is higher than an average potential of the electrode.

24 Claims, 9 Drawing Sheets

FIG. 3(a)
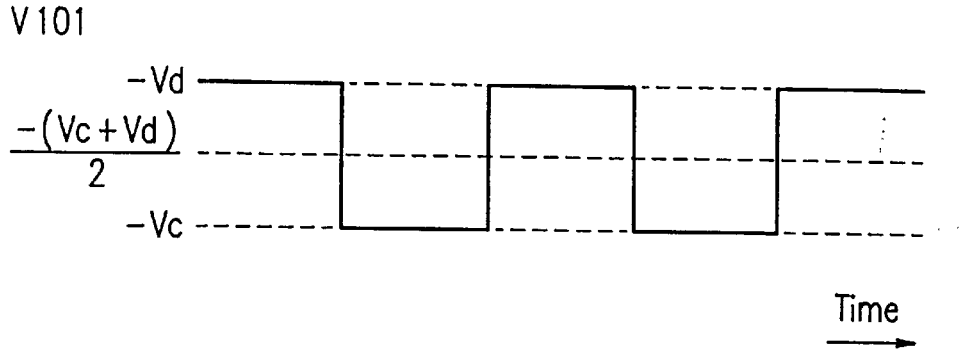
FIG. 3(b)
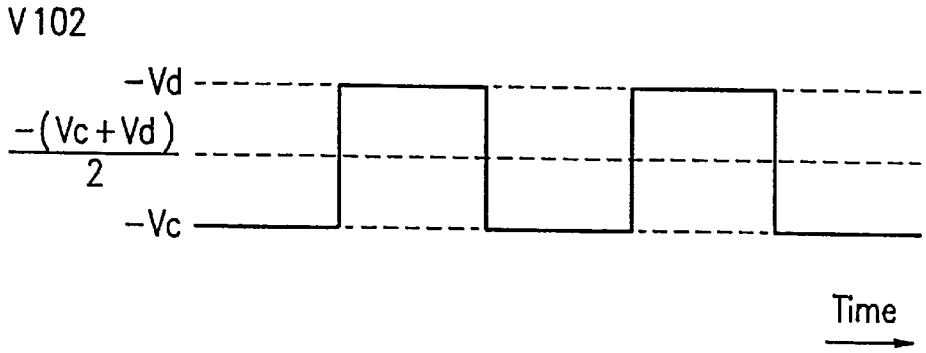
FIG. 4(a)
FIG. 4(b)
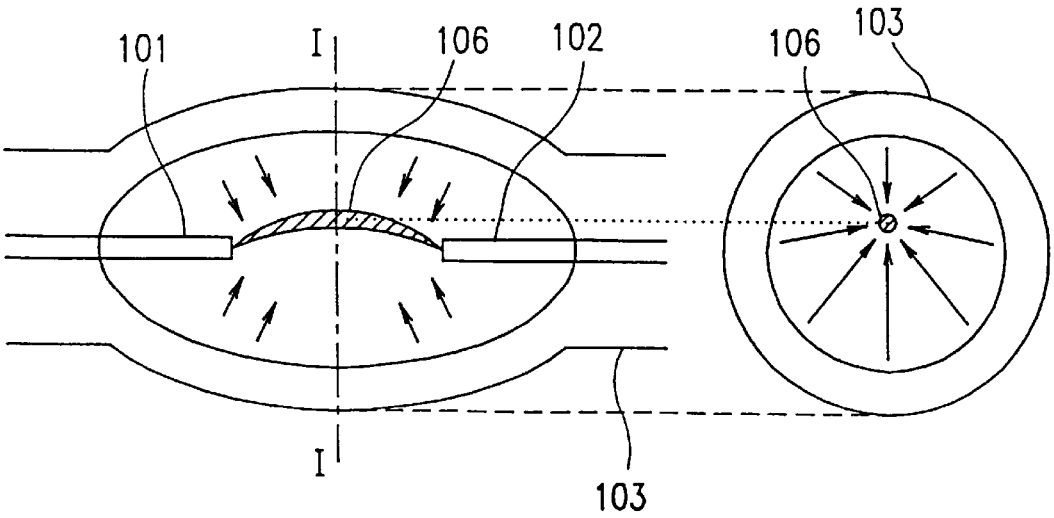

*FIG. 11*(a) *PRIOR ART*
(a) V101
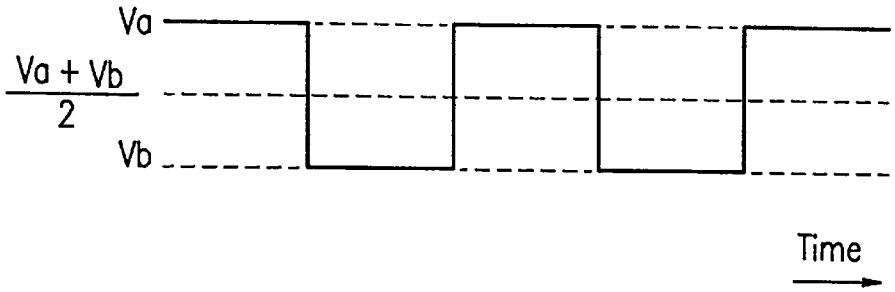
*FIG. 11*(b) *PRIOR ART*
(b) V102
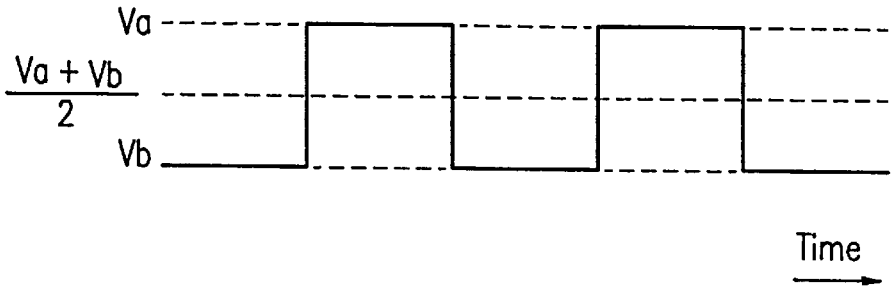
*FIG. 12*(a)
*PRIOR ART*
*FIG. 12*(b)
*PRIOR ART*
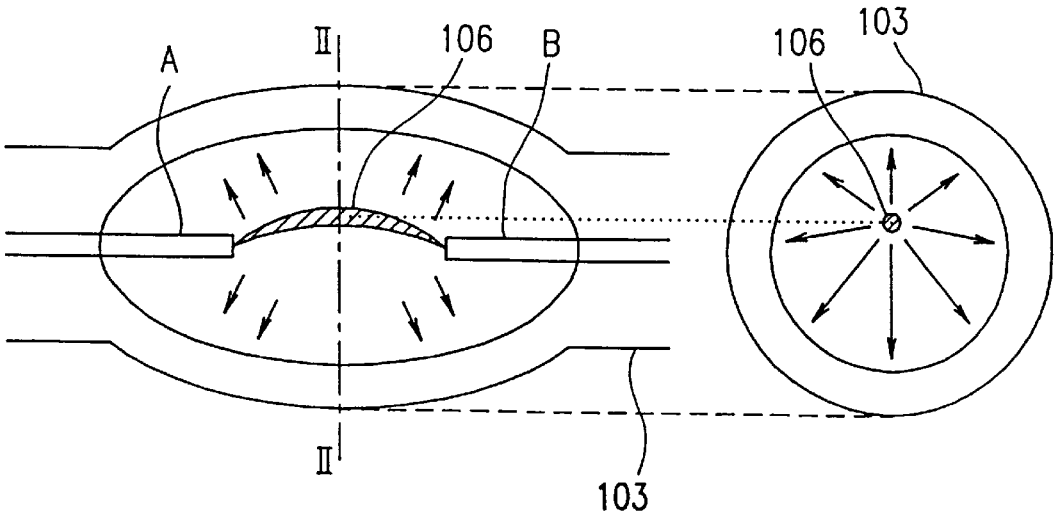

DISCHARGE LAMP LIGHTING DEVICE AND A METHOD FOR LIGHTING A DISCHARGE LAMP

BACKGROUND OF THE INVENTION

1. Field of the Invention

The present invention relates to a device and a method for lighting a discharge lamp. In particular, the present invention relates to a device and a method for lighting a discharge lamp such that the life of the discharge lamp is prolonged.

2. Description of the Related Art

FIG. 10 is a circuit diagram showing a conventional discharge lamp lighting device. In FIG. 10, 1001 denotes a metal halide lamp used as a discharge lamp, and 1002 denotes a lighting circuit for starting/lighting the metal halide lamp 1001. The lighting circuit 1002 is composed of a d.c. power supply 1003, an inverter 1004, and a high-voltage pulse generator 1005. The d.c. power supply 1003 is composed of a rectifying/smoothing circuit 1007 and a step-down type chopper circuit 1029. The rectifying/smoothing circuit 1007 rectifies and smoothes the output of a commercial a.c. power supply 1006 so as to convert it into d.c. power. The step-down type chopper circuit 1029 includes a transistor 1008, a diode 1009, a choke coil 1010, a capacitor 1011, resistors 1012, 1013 and 1014, and a controller 1015. The transistor 1008 receives the output of the rectifying/smoothing circuit 1007 and controls the power which is supplied to the metal halide lamp 1001 at a predetermined value. The step-down type chopper circuit 1029 detects an output voltage by means of the resistors 1012 and 1013 and detects an output current by means of the resistor 1014, and performs a mathematical operation for the two detected signals at the controller 1015. Thus, the step-down type chopper circuit 1029 controls i.e., turns on or off, the transistor 1008 (based on the output signal from the controller 1015) so as to maintain the output voltage of the step-down type chopper circuit 1029 at a predetermined value. The invertor 1004 includes transistors 1016, 1017, 1018, and 1019 and a driver 1020. The output signal from the driver 1020 functions to alternately generate a period during which the transistors 1017 and 1018 are turned ON and a period during which the transistors 1016 and 1019 are turned ON. Thus, the output of the d.c. power supply 1003 is converted into a.c. power before being output from the invertor 1004. The high-voltage pulse generator 1005 generates high-voltage pulses for starting the metal halide lamp 1001.

Hereinafter, the operation of the discharge lamp lighting device of the above-mentioned configuration will be described. As the metal halide lamp 1001 is started by the high-voltage pulses generated by the high-voltage pulse generator 1005, a discharge arc forms between electrodes of the metal halide lamp 1001. After the metal halide lamp 1001 is started, a signal which is in proportion with the lamp voltage of the metal halide lamp 1001 is detected by the resistors 1012 and 1013, and a signal which is in proportion with the lamp current of the metal halide lamp 1001 is detected by the resistor 1014. These detected signals are subjected to a power control operation by the controller 1015, and the transistor 1008 is controlled, i.e., turned on or off, in such a manner that the power supplied to the metal halide lamp 1001 is maintained at a predetermined power level. The output of the d.c. power supply 1003 is converted into a.c. power by the invertor 1004 before being supplied to the metal halide lamp 1001. Thus, the metal halide lamp 1001 stays lit. The frequency of the a.c. current, converted from the output of the d.c. power supply 1003, is often set at a frequency which can avoid problems such as fluctuation or extinguishment of the discharge arc or bursting of the metal halide lamp 1001 due to an acoustic resonance phenomenon inherent to HID lamps.

However, the above-mentioned conventional technique is known to have the following problems. It is assumed that the metal halide lamp 1001 has electrodes A and B and that the high-potential-side output potential of the d.c. power supply 1003 is Va and the low-potential-side output potential of the d.c. power supply 1003 is Vb. FIG. 11 is a graph showing potential of electrodes used in the conventional discharge lamp lighting device. The electrodes A and B are each at a positive potential whose value shifts in a rectangular waveform. When the potential of the electrode A is Va, the potential of the electrode B is Vb; when the potential of the electrode A is Vb, the potential of the electrode B is Va. Thus, the average potential of the electrodes A and B (i.e., the average potential of the discharge arc) becomes (Va+Vb)/2. Since the minus-side potential of the lighting circuit is generally grounded, Vb is substantially zero. As a result, the average potential of the discharge arc of the metal halide lamp 1001 becomes positive with respect to the ground potential.

FIG. 12 is a diagram showing electric field in the conventional metal halide lamp 1001. Since it is likely that elements surrounding the metal halide lamp 1001 are maintained at the ground potential (that is, the average potential of the discharge arc becomes higher than the potentials of the surrounding elements), an electric field is generated in the direction of the elements, i.e., in the direction of the tube 103 wall of the arc tube from the discharge arc 106, i.e., from the discharge arc 106 toward outside, as indicated by the arrows in (a) and (b) of FIG. 12. A cross-sectional view taken on line II—II of (a) in FIG. 12 is shown in (b) of FIG. 12.

When the metal halide lamp 1001 is generating light, the light-emitting metals (e.g., Na and Sc) sealed within the arc tube are ionized so as to become positive ions having positive electric charge, and therefore are forced to move toward the tube wall due to the electric field generated in the direction of the tube wall from the discharge arc inside the discharge arc. Thus, the metal ions are likely to be moved toward the tube wall owing to the effect of the electric field generated inside the arc tube. As a result, the metal ion density increases in the vicinity of the tube wall.

On the other hand, the arc tube of the metal halide lamp 1001 is generally composed of quartz glass, which is known to have devitrification through reaction with metal ions. That is, an increase in the metal ion density in the vicinity of the tube wall increases the chances of the quartz glass reacting with the metal ions, thereby resulting in devitrification.

SUMMARY OF THE INVENTION

A discharge lamp lighting device according to the present invention includes: a discharge lamp including an electrode; and a lighting circuit for lighting the discharge lamp, the lighting circuit being connected to the discharge lamp, wherein the discharge lamp includes a conductor at least partially surrounding the electrode, and the lighting circuit provides a potential for the conductor that is higher than an average potential of the electrode.

In one embodiment of the invention, the discharge lamp includes an arc tube having two or more electrodes provided inside the arc tube, a light-emitting gas being sealed in the arc tube, and the conductor included in the discharge lamp is disposed on a surface of the arc tube.

In another embodiment of the invention, the conductor is a light-transmitting film.

In still another embodiment of the invention, the discharge lamp includes an arc tube having two or more electrodes provided inside the arc tube, a light-emitting gas being sealed in the arc tube, and an outer tube concealing the arc tube, and wherein the conductor included in the discharge lamp is disposed on a surface of the outer tube.

In still another embodiment of the invention, the ratio of a diameter of the outer tube to a diameter of the arc tube is 5.0 or less.

In still another embodiment of the invention, the conductor includes at least one straight stripe-shaped film extending in parallel to an axial direction of the outer tube.

In still another embodiment of the invention, the conductor includes a plurality of said straight stripe-shaped films, the straight stripe-shaped films being disposed at equal intervals and at least partially surrounding the outer tube.

In still another embodiment of the invention, the conductor is a helical stripe-shaped film disposed so as to at least partially surround the outer tube.

In still another embodiment of the invention, the conductor is a light-transmitting film.

In still another embodiment of the invention, the conductor includes at least one straight film extending in parallel to an axial direction of the outer tube.

In still another embodiment of the invention, the conductor includes a plurality of said straight stripe-shaped films, the straight stripe-shaped films being disposed at equal intervals and at least partially surrounding the outer tube.

In still another embodiment of the invention, the conductor is a helical stripe-shaped film disposed so as to at least partially surround the outer tube.

In still another embodiment of the invention, the conductor is disposed in an upper portion of the outer tube.

In still another embodiment of the invention, the conductor includes at least one straight stripe-shaped film extending in parallel to an axial direction of the outer tube.

In still another embodiment of the invention, the conductor is disposed on an inner surface of the outer tube.

In still another embodiment of the invention, the conductor includes at least one straight stripe-shaped film extending in parallel to an axial direction of the outer tube.

In still another embodiment of the invention, the conductor includes a plurality of said straight stripe-shaped films, the straight stripe-shaped films being disposed at equal intervals and at least partially surrounding the outer tube.

In still another embodiment of the invention, the conductor is a helical stripe-shaped film disposed so as to at least partially surround the outer tube.

In still another embodiment of the invention, the conductor has a potential equal to a ground potential.

In still another embodiment of the invention, the lighting circuit further includes an auxiliary power supply for providing a potential for the conductor that is higher than a maximum potential of the electrode.

In another aspect of the invention, there is provided a method for lighting a discharge lamp including an electrode and a conductor at least partially surrounding the electrode, wherein the method includes the step of providing a potential for the conductor that is higher than an average potential of the electrode.

In one embodiment of the invention, said step provides a potential that is higher than a maximum potential of the electrode for the conductor.

Thus, in accordance with the present invention, the potential of the vicinity of a discharge arc of a discharge lamp is increased to be higher than the average potential of the discharge arc, thereby generating an electric field in the direction of the discharge arc from the tube wall of the arc tube. As a result, the metal ion density in the vicinity of the tube wall is decreased, thereby suppressing the reaction between the quartz glass composing the arc tube and the metal ions in the vicinity of the tube wall, so as to prevent devitrification.

Thus, the invention described herein makes possible the advantage of providing a discharge lamp lighting device and a method of lighting a discharge lamp which can prolong the life of the discharge lamp by preventing devitrification.

This and other advantages of the present invention will become apparent to those skilled in the art upon reading and understanding the following detailed description with reference to the accompanying figures.

BRIEF DESCRIPTION OF THE DRAWINGS

FIG. 3 includes (a) and (b), which are diagrams showing the potentials of electrodes 101 and 102 of the discharge lamp 1 of Example 1.

FIG. 4 includes (a) and (b), which are diagrams showing an electric field created inside an arc tube 103 of the discharge lamp 1.

FIG. 11 includes (a) and (b), which are diagrams showing the potentials of electrodes A and B of the discharge lamp 1001 of a conventional discharge lamp lighting device.

FIG. 12 includes (a) and (b), which are cross-sectional views showing an electric field generated inside the discharge lamp of a conventional discharge lamp lighting device.

DESCRIPTION OF THE PREFERRED EMBODIMENTS

Hereinafter, the discharge lamp lighting device and a method for lighting a discharge lamp according to the present invention will be described by way of examples and with reference to the accompanying figures. Like constituent elements are indicated by like numerals in the following descriptions.

EXAMPLE 1

Figure 1:
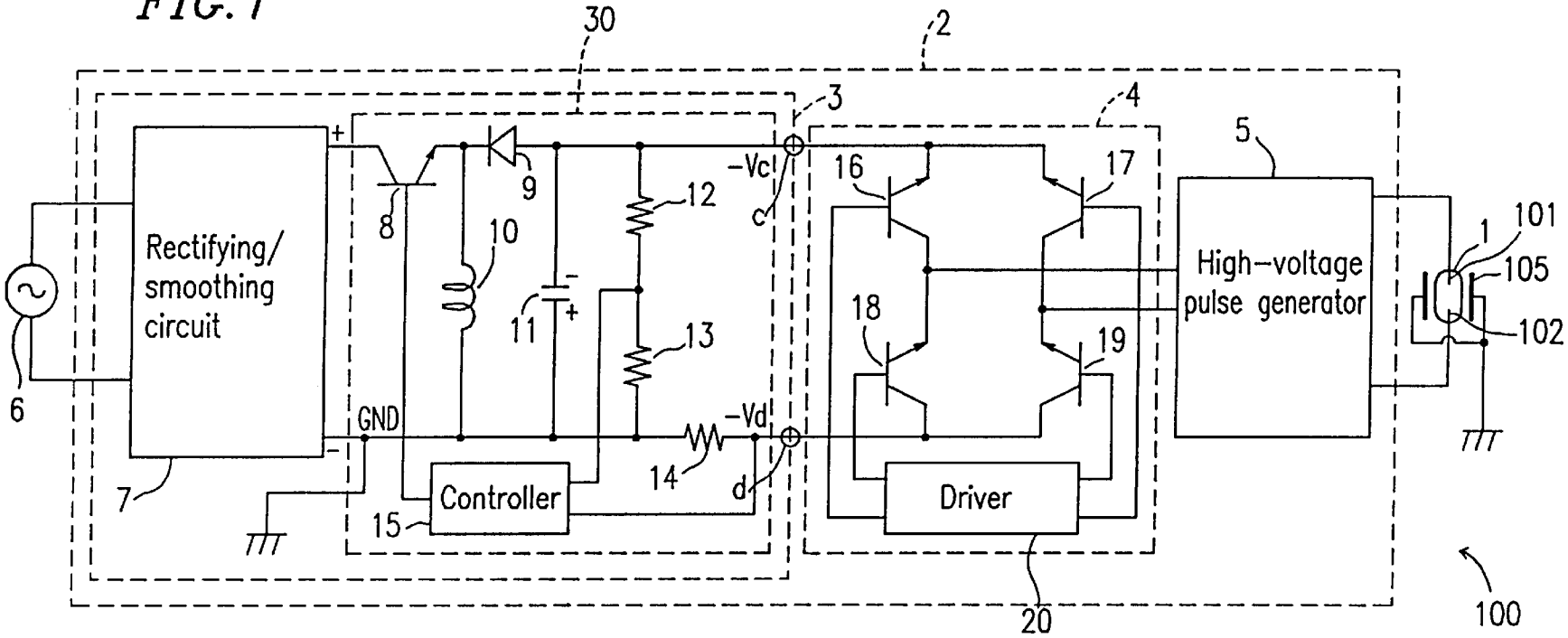
FIG. 1 is a block diagram showing a discharge lamp lighting device 100 according to Example 1 of the present invention.

FIG. 1 is a block diagram showing a discharge lamp lighting device 100 according to Example 1 of the present invention. In the present specification, it is generally assumed that the discharge lamp lighting device 100 includes a discharge lamp 1 and a lighting circuit 2.

The discharge lamp 1 includes an arc tube having electrodes 101 and 102 sealed therein and a conductor 105 disposed in the vicinity of the electrodes 101 and 102. The shape of the conductor 105 will be described later in detail. The discharge lamp 1 can have an outer tube surrounding the arc tube.

The lighting circuit 2 supplies a voltage for starting/lighting the discharge lamp 1 to the electrodes 101 and 102. The lighting circuit 2 includes a d.c. power supply 3, an invertor 4, and a high-voltage pulse generator 5. The d.c. power supply 3 receives a.c. voltage from a commercial a.c. power supply 6 and converts the a.c. power into d.c. power, so as to output the d.c. power to the invertor 4.

The d.c. power supply 3 includes a rectifying/smoothing circuit 7 and a power regulator 30. The rectifying/smoothing circuit 7 receives a.c. power and rectifies and smoothes the received a.c. power. The power regulator 30 receives power from the rectifying/smoothing circuit 7 and controls the power to be output to the invertor 4. The power regulator 30 can be realized by using known techniques. For example, the power regulator 30 can be composed of a transistor 8, a diode 9, a choke coil 10, a capacitor 11, resistors 12, 13, and 14, and a controller 15. Under such configuration, the controller 15 controls the output voltage of the d.c. power supply 3 by monitoring a divided voltage obtained from the resistors 12 and 13, and controls the output current of the d.c. power supply 3 by monitoring voltage drop at the resistor 14. As a result, the power regulator 30 can control the output power (i.e., a product of the output voltage multiplied by the output current) at a predetermined value. The controller 15 controls, i.e., turns on and off, the transistor 8 in accordance with the corresponding values of the monitored output voltage and output current. The above configuration is merely an example, though; the present invention is not limited to the d.c. power supply 3 of the above configuration.

The inverter 4 includes transistors 16 to 19 and a driver 20. The invertor 4 receives and converts the output of the d.c. power supply 3 into a.c. power, and outputs the a.c. power to the high-voltage pulse generator 5. The driver 20 drives the transistors 16 to 19 in such a manner that the pair of transistors 16 and 19 and the pair of transistors 17 and 18 are alternately turned on.

The high-voltage pulse generator 5 generates and outputs to the discharge lamp 1 high-voltage pulses for starting the discharge lamp 1. Once the discharge lamp 1 is lit and a discharge arc has developed, the high-voltage pulse generator 5 stops generating high-voltage pulses, and instead outputs a voltage sufficiently high for maintaining the discharge arc.

Figure 2A:
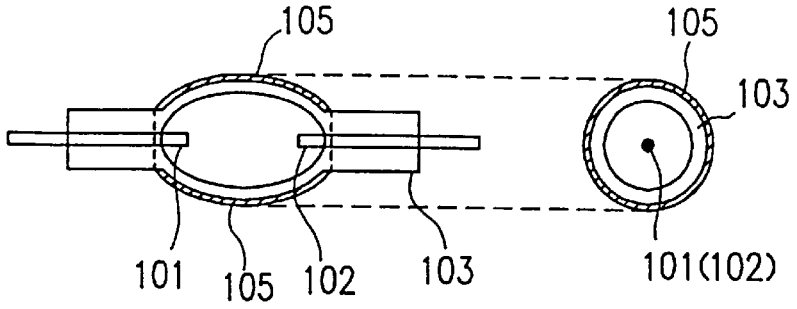
FIG. 2 includes (a) to (c), which are diagrams showing the configuration of a discharge lamp 1 according to Example 1.
Figure 2B:
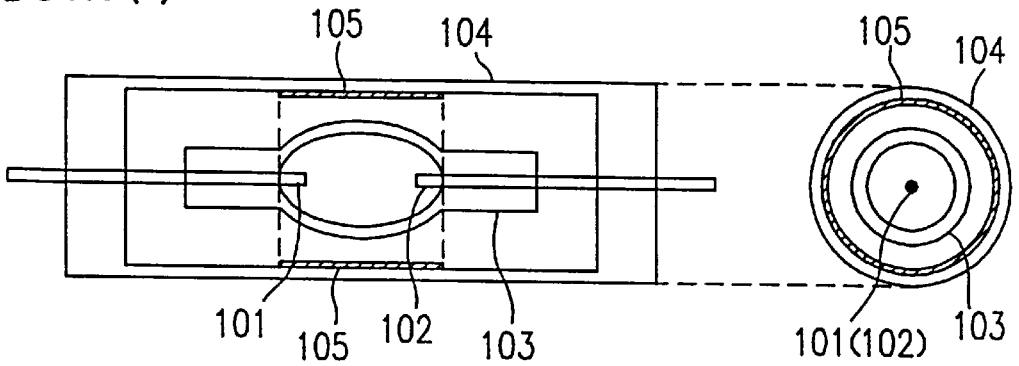
Figure 2C:
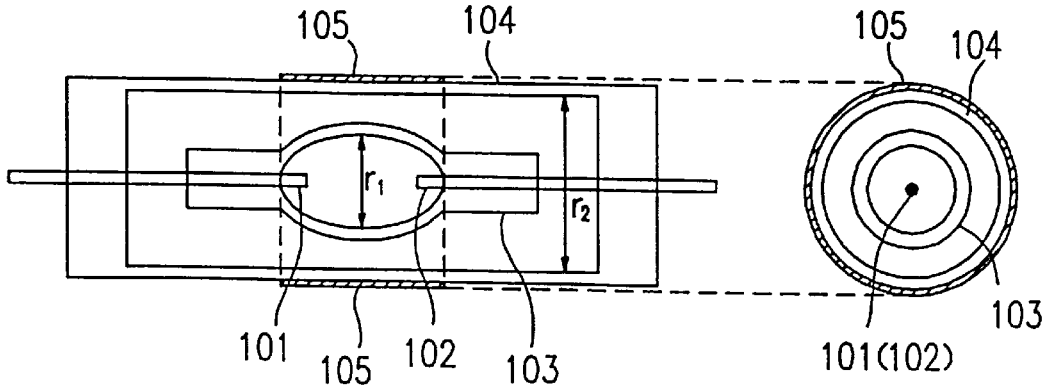

Diagrams showing the configuration of the discharge lamp 1 are illustrated in (a) to (c) of FIG. 2. An arc tube 103 is formed of quartz glass, with start gas (e.g., xenon) and light-emitting metals (e.g., Na, Sc, and Hg) sealed therein. A discharge space is created inside the arc tube 103. The cross section of the arc tube 103 in Example 1, taken on a plane containing the electrodes 101 and 102, is shown to be an oblong ellipse. However, the shape of the arc tube 103 can also be cylindrical or spherical, for example.

The electrodes 101 and 102 are formed of tungsten, and are located so as to project into the discharge space of the arc tube 103. The electrodes 101 and 102 are connected to the lighting circuit 2.

In (a) of FIG. 2, the conductor 105 is provided on the outer surface (i.e., the surface opposite from the discharge space) of the arc tube 103. The conductor 105 in Examples 1 and 2 is a light-transmitting and conductive thin film. ITO (indium tin oxide ) can be suitably used for the conductor 105, but the present invention is not limited thereto. The conductor 105 is formed by being applied onto the surface of the arc tube 103.

In (b) of FIG. 2, an outer tube 104 is formed so as to surround the arc tube 103. The outer tube 104 is provided for the purpose of preventing explosion and removing ultraviolet rays. For example, the outer tube 104 is formed of hard glass. The interspace between the outer tube 104 and the arc tube 103 is filled with inert gas, such as argon gas. In (b) of FIG. 2, the conductor 105 is provided on the inner surface of the outer tube 104 (i.e., the surface of the outer tube 104 facing the arc tube 103).

In (c) of FIG. 2, the conductor 105 is provided on the outer surface (i.e., the opposite surface of the surface facing the arc tube 103) of the outer tube 104).

The conductors 105 shown in (c) and (b) of FIG. 2 are formed by using the same material and method for forming the conductor 105 shown in (a) of FIG. 2. In any of (a) to (c) of FIG. 2, the conductor 105 is coupled to the ground GND of the d.c. power supply 3 via a wire (not shown).

Hereinafter, the operation of the discharge lamp lighting device 100 having the above-mentioned configuration will be described. The high-voltage pulse generator 5 starts the discharge lamp 1 by supplying highvoltage pulses to the electrodes 101 and 102 of the discharge lamp 1. As a result, a discharge arc is created between the electrodes 101 and 102 in the discharge space inside the arc tube 103. After the discharge lamp has started, the controller 15 controls the transistor 8 so that the power supplied to the discharge lamp 1 will be at a predetermined lamp power level based on a signal which is in proportion with the lamp voltage of the discharge lamp 1 (detected by the resistors 12 and 13) and a signal which is in proportion with the lamp current of the discharge lamp 1 (detected by the resistor 14). As a result, the output of the d.c. power supply 3 is converted into a.c. power by the invertor 4 before being supplied to the discharge lamp 1. The discharge arc within the arc tube 103 of the discharge lamp 1 is maintained by the power supplied in the above-mentioned manner. In Example 1, the d.c. power supply 3 is composed of a polarity-inversion type chopper circuit. A negative potential (with respect to the ground GND potential) is supplied to an output terminal c of the d.c. power supply 3.

Diagrams showing the potentials of the electrodes 101 and 102 of the discharge lamp 1 of Example 1 are illustrated in (a) and (b) of FIG. 3. In FIG. 3, the axis of abscissas indicates time, while the axis of ordinates indicates the potentials of the electrodes 101 and 102 with respect to the ground GND of the d.c. power supply 3. Herein, it is assumed that the output terminals c and d of the d.c. power supply 3 have potentials −Vc and −Vd, respectively (where Vc>0 and Vd>0), and that the electrodes 101 and 102 have potentials V101 and V102, respectively. The levels of potentials V101 and V102 shift in a rectangular waveform. The average value of the potentials V101 and the average value of the potentials V102 are both −(Vc+Vd)/2. The average potentials of the electrodes 101 and 102 are substantially equal to the average potential of the discharge arc of the discharge lamp 1. The potential of the conductor 105 with respect to the ground GND is zero.

Diagrams showing an electric field created inside the arc tube 103 are illustrated in (a) and (b) of FIG. 4. A cross section taken at line I—I in (a) of FIG. 4 is illustrated in (b)

of FIG. 4. Since the discharge arc 106 is influenced by a convection current occurring inside the arc tube 103, the discharge arc 106 is slightly "bent" toward the upper portion of the arc tube 103. The potential of the conductor 105 (equal to the ground GND potential) can be considered to be substantially equal to the potential −Vd of the output terminal d of the d.c. power supply 3. Therefore, the potential of the conductor 105 is higher than the average potentials of the electrodes 101 and 102 (i.e., the average potential of the discharge arc). Accordingly, an electric field created in the direction of the discharge arc 106 from the conductor 105 (i.e., an electric field in the direction of the discharge arc 106 from the tube wall of the arc tube 103, indicated by the arrows in (a) and (b) of FIG. 4) exists inside the arc tube 103 as shown in (a) and (b) of FIG. 4. The electric field, thus created in the direction of the center of the arc tube 103 from the tube wall of the arc tube 103, forces the metal ions (such as Na, Sc, and Hg), which have become positive ions inside the arc tube 103, to move toward the discharge arc 106. As a result, the positive ions of metal ions are moved away from the tube wall of the arc tube 103, thereby preventing devitrification.

According to Example 1, the conductor 105 surrounding the electrodes 101 and 102 of the discharge lamp 1 has a potential higher than the average potentials of the electrodes 101 and 102. Such a configuration causes an electric field to be generated in the direction of the center of the discharge arc 106, inside the arc tube 103. As a result, the devitrification reaction of the quartz glass composing the arc tube 103 is suppressed, thereby realizing a long-life lamp.

Moreover, by providing the conductor 105 on the outer surface of the outer tube 104 as shown in (c) of FIG. 2, there is provided an advantage of simplifying the production process of the lamp (because such a conductor 105 can be formed in the last step of the production process of the discharge lamp 1).

In (b) and (c) of FIG. 2, the diameter r1 of the arc tube 103 and the diameter r2 of the outer tube 104 preferably satisfy the relationship $r2/r1 \leqq 5.0$ for the sake of devitrification prevention. This relationship is desirable where the outer tube 104 is formed around the arc tube 103 and the conductor 105 is provided for the outer tube 104. The same also applies to Example 2.

EXAMPLE 2

Figure 5:
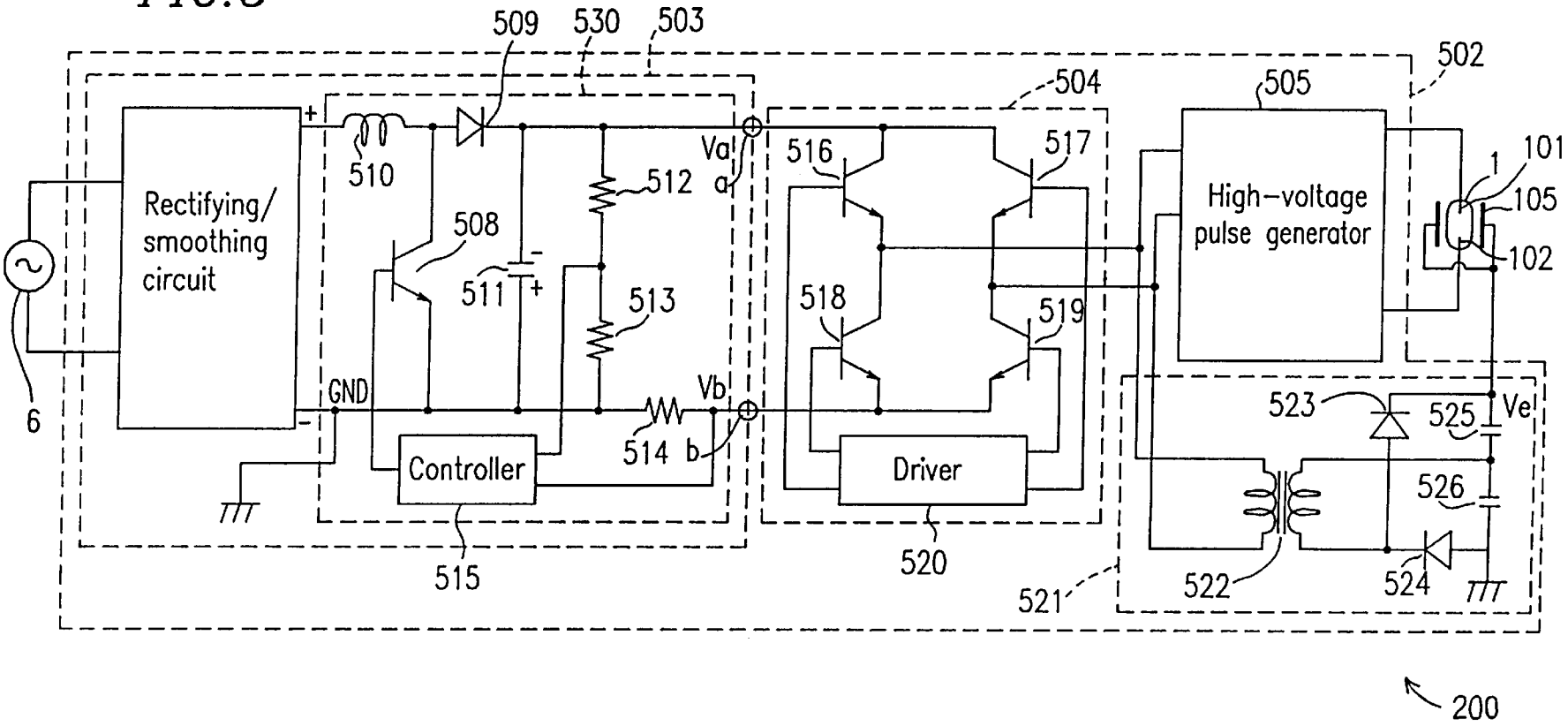
FIG. 5 is a block diagram showing a discharge lamp lighting device according to Example 2 of the present invention.

FIG. 5 is a block diagram showing a discharge lamp lighting device according to Example 2 of the present invention. The discharge lamp lighting device 200 of Example 2 has the same configuration as that of the discharge lamp lighting device 100 of Example 1, except that a lighting circuit 502 includes a power supply 521 for supplying a potential to a conductor 105 which is higher than the average potentials of electrodes 101 and 102.

A power regulator 530 supplies potentials Va and Vb (with respect to the ground GND) to output terminals a and b, respectively. The power regulator 530 includes a transistor 508, a diode 509, a choke coil 510, a capacitor 511, resistors 512, 513, and 514, and a controller 515, and functions in the same manner the power regulator 30 of Example 1 functions.

The invertor 504 includes transistors 516 to 519 and a driver 520. The invertor 504 functions in the same manner the invertor 4 of Example 1 does.

The power supply 521 receives the output voltage of the invertor 504 and generates a potential 2Va (with respect to the ground GND), which is supplied to the conductor 105. The power supply 521 is a so-called voltage doubling rectifier, composed of a transformer 522, diodes 523 and 524, and capacitors 525 and 526.

The transformer 522 of the power supply 521 is provided in order to insulate the power supply 521 from a d.c. power supply 503 and the invertor 504. The ratio of the number of turns of the secondary winding (i.e., closer to the conductor 105) to the number of turns of the primary winding (i.e., closer to the invertor 504) of the transformer 522 is 1:1. A high-voltage pulse generator 505 stops the generation of high-voltage pulses once a discharge lamp 1 is lit. The discharge lamp 1 can have any of the structures shown in (a) to (c) of FIG. 2. The discharge lamp lighting device 200 of Example 2 having the above-mentioned configuration has the same operation of that of the discharge lamp lighting device 100 of Example 1, except that a potential which is higher than the average potentials of the electrodes 101 and 102 is supplied to the conductor 105 of the discharge lamp lighting device 200.

Figure 6:
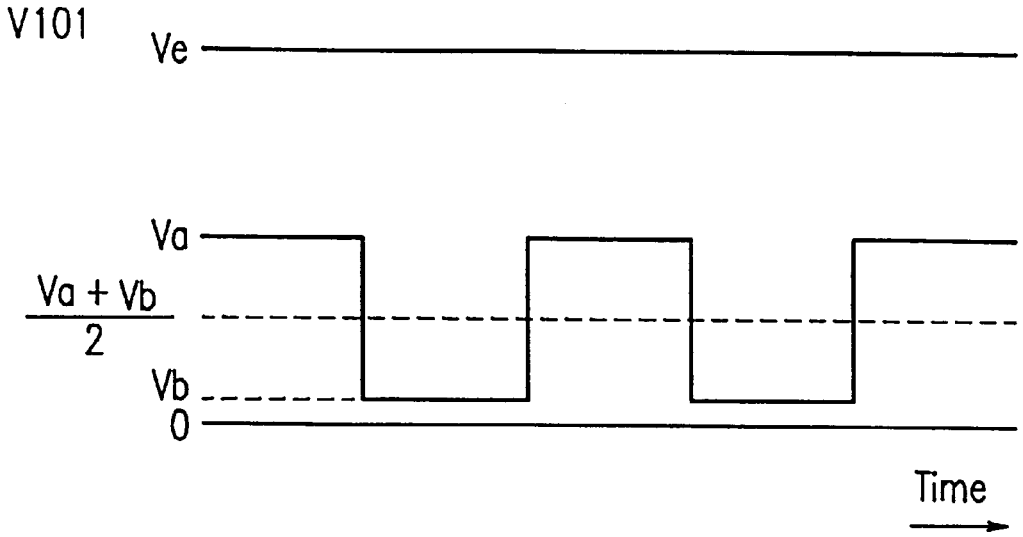
FIG. 6 includes (a) and (b), which are diagrams showing the potentials of electrodes 101 and 102 of the discharge lamp 1 of Example 2.
Figure 6:
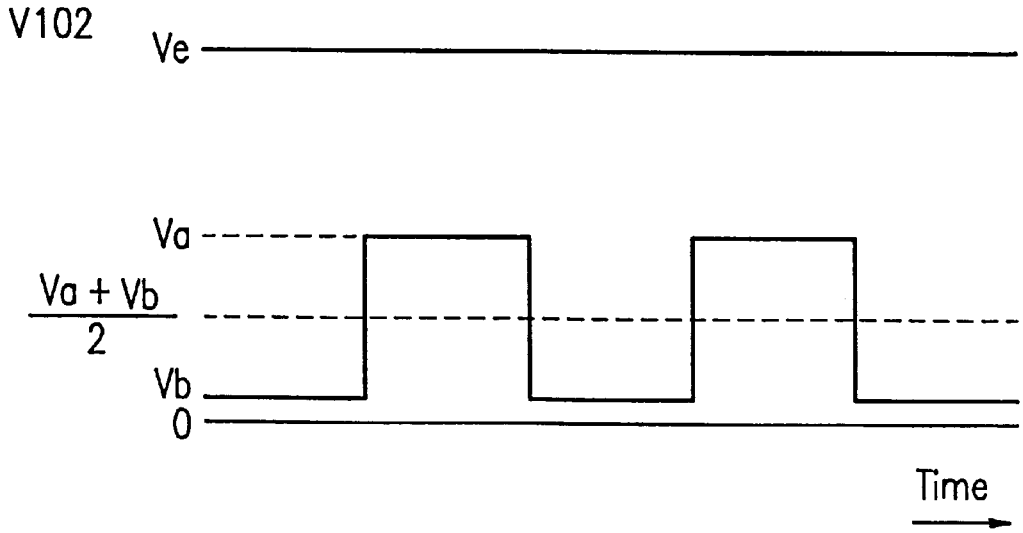

Diagrams showing the potentials of the electrodes 101 and 102 of the discharge lamp 1 of Example 2 are illustrated in (a) and (b) of FIG. 6. In FIG. 6, the axis of abscissas indicates time, while the axis of ordinates indicates the potentials of the electrodes 101 and 102 with respect to the ground GND of the d.c. power supply 503. Herein, it is assumed that the output terminals a and b of the d.c. power supply 503 have potentials Va and Vb, respectively (where Va>0 and Vb>0), and that the electrodes 101 and 102 have potentials V101 and V102, respectively. The potentials V101 and V102 shift in a rectangular waveform. The average value of the potentials V101 and the average value of the potentials V102 are both (Va+Vb)/2. The average potentials of the electrodes 101 and 102 are substantially equal to the average potential of the discharge arc of the discharge lamp 1. The potential Va of the output terminal a of the d.c. power supply 503 is higher than the potential Vb of the output terminal b of the d.c. power supply 503.

As described in Example 1, the potential Vb is substantially equal to the ground GND. Therefore, the average voltages of the electrodes 101 and 102 (which are substantially equal to the average voltage of a discharge arc 106) are equal to Va/2. The power supply 521 is a voltage doubling rectifier connected to the output of the invertor 504. Assuming that the voltage drop of the transistors 516 to 519 while being ON is substantially 0 [V], the output potential Ve of the power supply 521 equals ((Va−Vb)×2). Since the potential Vb is substantially 0 [V], the potential of the conductor 105, which is connected to the power supply 521, becomes 2Va.

The potentials of the electrodes 101 and 102 each take a minimum value Vb (which is substantially zero) and a maximum value Va. Therefore, the potential Ve of the conductor 105 is higher than both the potential of the electrode 101 and the potential of the electrode 102. Specifically, the potential of the conductor 105 has a difference of at least Va (Va>0) from the potentials of the electrodes 101 and 102.

In Example 2 as well, an electric field created in the direction of the discharge arc 106 from the conductor 105 (as indicated by the arrows in (a) and (b) of FIG. 4 in the description of Example 1) exists. The electric field thus created forces metal ions (such as Na, Sc, and Hg), which have become positive ions inside the arc tube, to move toward the discharge arc 106. As a result, the positive ions of metal ions are moved away from the tube wall of the arc tube, thereby reducing the density of metal ions in the vicinity of the tube wall.

Unlike in Example 1, the potential Ve of the conductor 105 according to Example 2 is always higher than both the potential of the electrode 101 and the potential of the electrode 102. That is, the difference of the average potentials of the electrodes 101 and 102 (i.e., the average potential of the discharge arc 106) from the potential of the conductor 105 is larger than in the case of Example 1. As a result, stronger electric field is generated in a space in the arc tube 103, thereby obtaining an even greater effect of devitrification prevention according to Example 2. This results in further increasing the lifetime of the discharge lamp 1.

Figure 7A:
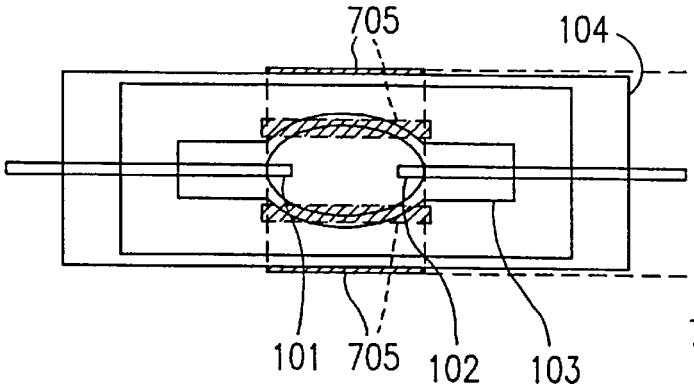
FIG. 7 is a diagram showing a discharge lamp having a thin film conductor in the form of a plurality of stripes.
Figure 7B:
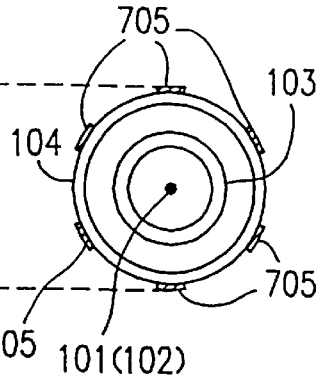

Hereinafter, various shapes of the discharge lamp 1 which can be employed in Examples 1 and 2 will be described. FIG. 7 is a diagram showing a discharge lamp having a thin film in the form of a plurality of stripes. As in the case of FIG. 2, where a light-transmitting and conductive thin film (functioning as the conductor 105) is provided so as to surround the entire circumference of the cross section of the arc tube 103, a light-transmitting and conductive thin film is used as conductors 705 in FIG. 7. The conductors 705 provide a potential that prevents devitrification for elements surrounding the electrodes 101 and 102 (as does the conductor 105 in Example 1). The conductors 705 are in the form of stripes provided on the outer surface of an outer tube 104. A space is secured between adjacent conductors 705. The stripe-shape conductors 705 provide the effect of realizing an electric field which is sufficient for devitrification prevention while improving the transmittance of the light emitted from the lamp. Although six stripes of thin film conductors 705 are shown to be applied in FIG. 7, the present invention offers any limit to the number of such stripes. A similar effect can be attained by providing conductive metal wires (not shown) or the like on the outer tube 104 in the place of the stripe-shape thin film conductors 705 shown in FIG. 7.

Figure 8A:
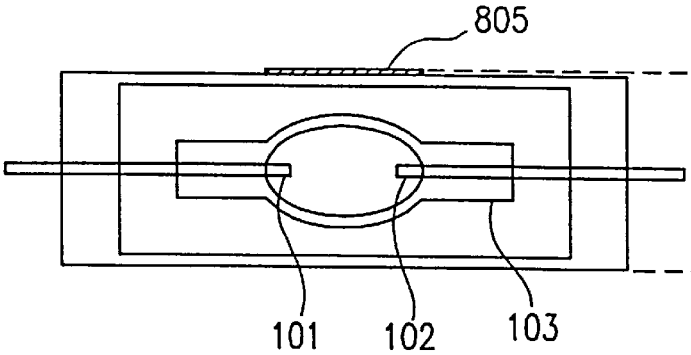
FIG. 8 shows a discharge lamp which has only one stripe of thin film conductor.
Figure 8B:
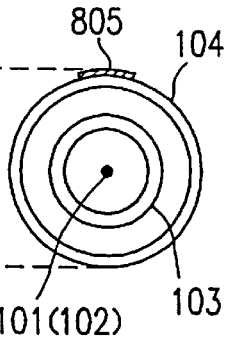

FIG. 8 shows a discharge lamp which has only one stripe of thin film 805. The conductor 805 shown in FIG. 8 has a stripe shape, and is provided on an upper portion of the outer tube 104, where an arc tube 103 is most likely to have devitrification. In the case where the discharge lamp 1 is disposed in such a manner that the longitudinal direction of the discharge lamp 1 becomes horizontal, the upper portion of the arc tube 103 becomes particularly susceptible to devitrification. Herein, "upper" is defined as indicating the direction opposite to the direction in which any object is attracted to the earth due to gravity. Specifically, gas sealed inside the arc tube 103 moves due to a convection current inside the arc tube 103 which in turn is caused by gravity, thereby making the upper portion of the inside of the arc tube 103 most susceptible to devitrification. Therefore, by providing the stripe-shape conductor 805 on the upper portion of the arc tube 103, the area of the conductor 805 to be applied can be reduced while preventing devitrification. The adoption of the discharge lamp configuration of FIG. 8 achieves devitrification and cost reduction.

Figure 9A:
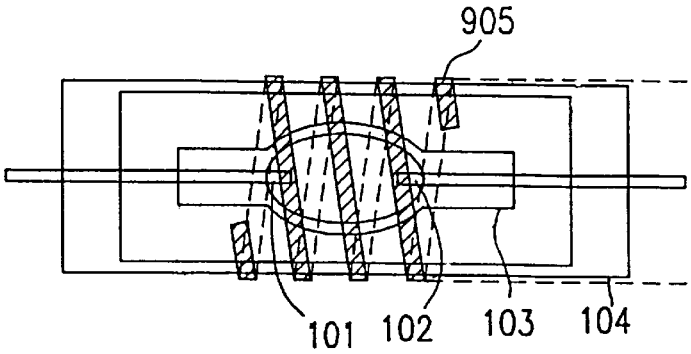
FIG. 9 shows yet another shape of the conductor to be employed in Examples 1 and 2.
Figure 9B:
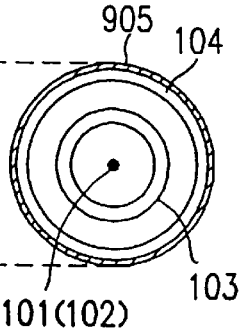
Figure 10:
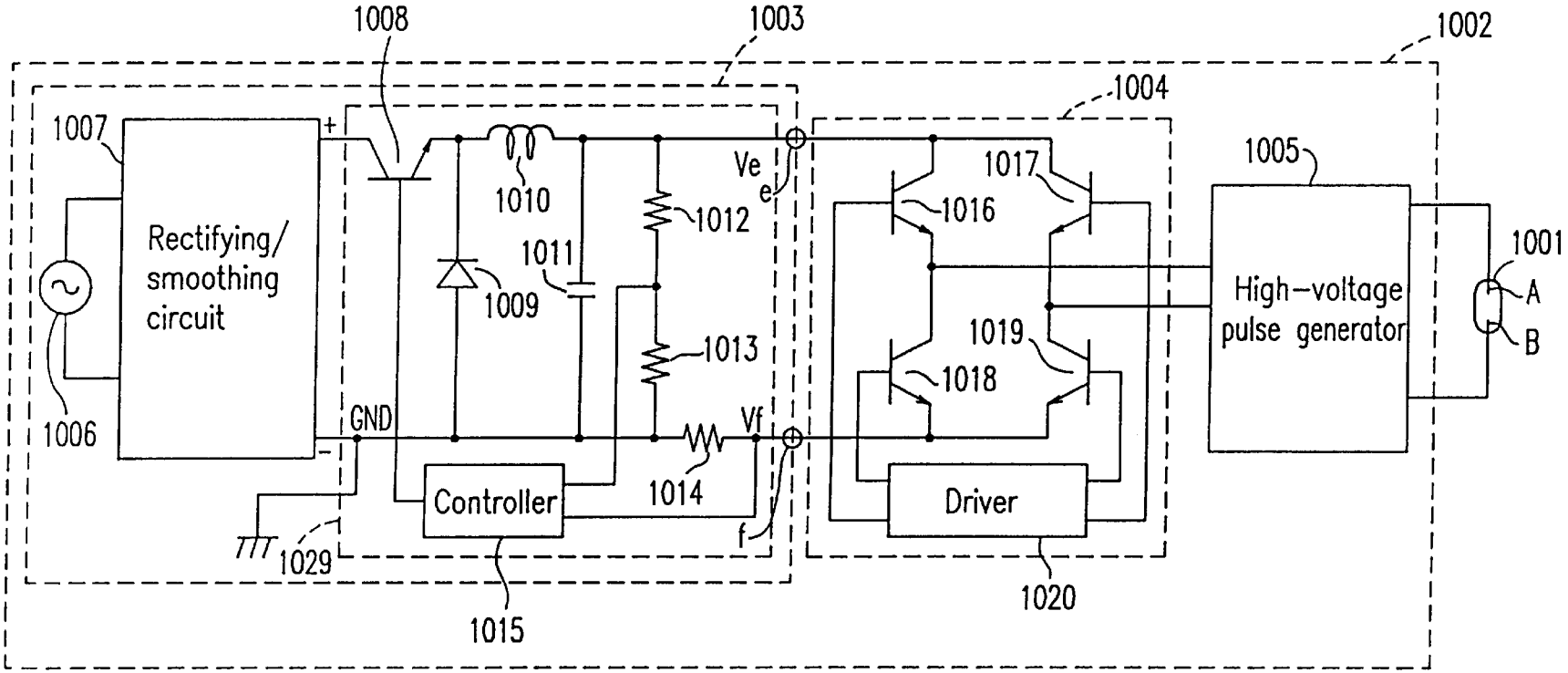
FIG. 10 PRIOR ART
FIG. 10 is a diagram showing the configuration of a conventional discharge lamp lighting device.

FIG. 9 shows yet another shape of the conductor to be employed in Examples 1 and 2. A conductor 905 shown in FIG. 9 is a conductive and light-transmitting thin film formed in a helical shape on the outer surface of an outer tube 104.

When the discharge lamp configuration shown in (b) of FIG. 2 (where the conductor 105 is applied in the form of a thin film on the inside of the outer tube 104) is adopted for Examples 1 and 2 of the present invention, it is unnecessary to provide any particular insulation means because a user never directly touches the conductor 105. In the case of (a) and (c) of FIG. 2, insulation can be easily effected by applying an insulation film on the conductor 105. Moreover, the conductor 105 does not need to be applied all over the surface of the outer tube 104, but can be applied in stripes (as described above), in a helical stripe, or in concentric circles as long as a sufficient electric field is realized.

Although a conductive thin film was used in the above Examples, any element can replace such conductors; for example, it is applicable to employ a luminaire device, which is maintained at a certain potential, in the surroundings of the discharge arc of the discharge lamp. Although a d.c. voltage, which was obtained by rectifying and smoothing the output of the a.c. power supply 6 by the rectifying/smoothing circuit 7, was input to the d.c. power supply 3 in Example 1, it is also applicable to directly input a d.c. voltage to the discharge lamp.

The conductor 105 in Example 2 can also have an a.c. potential shifting over time (instead of a d.c. potential, which does not shifting over time), as long as the potential is higher than the average potential of the discharge arc. Although a voltage approximately twice as high as the output voltage of the d.c. power supply was applied to the conductor 105 in Example 2, it is also applicable to adopt other potential levels which are higher than the average potential of the discharge arc 106. Although the power supply 521 in Example 2 was a voltage doubling rectifier, it is also applicable to employ any other method, e.g., a step-up chopper circuit, as long as a potential higher than the average potentials of the electrodes 101 and 102 (i.e., the average potential of the discharge arc 106) is generated. Although the input of the power supply 521 was directly coupled to the output of the invertor 504, it is also applicable to couple the power supply 521 to the output of another element, e.g., the d.c. power supply 503.

Although Examples 1 and 2 concerned reaction between quartz glass and light-emitting metals, the present invention is also effective for the prevention of reaction between other kinds of glass or ceramic and other kinds of light-emitting metals.

Figure 13:
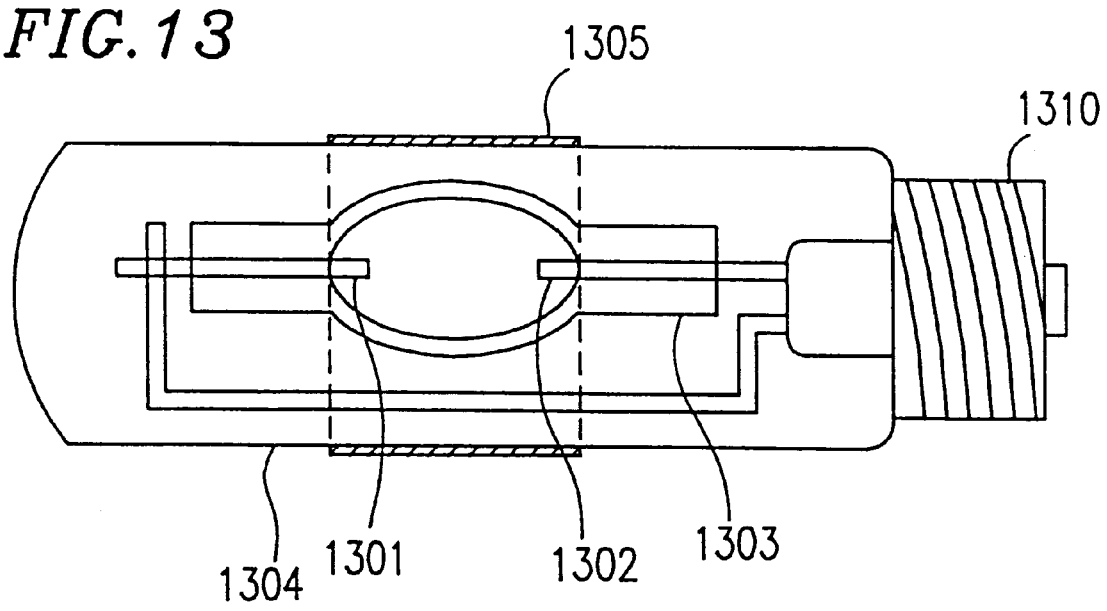
FIG. 13 shows a discharge lamp having a base on one side of an outer tube.

Although the discharge lamps in the above Examples were described to have two bases, it will be appreciated that the present invention is also applicable to a discharge lamp with only one base. For example, the discharge lamp shown in FIG. 13, which has a base 1310 on one side of an outer tube 1304, can be employed. An arc tube 1303 is the similar to the arc tube 103. In this case, too, the above-described effect of the present invention can be attained by ensuring that electrodes 1301 and 1302, and a conductor 1305, have appropriate potentials described above.

Although two electrodes were described to be present inside the arc tube in the above Examples, the number of electrodes is not limited thereto.

The conductor, although exemplified as thin films, can be a wire composed of metal, for example.

The shape of the conductor and other features described above are applicable in combination according to the present invention. For example, the stripe-shaped conductor can be used in combination with the condition defined by the expression "$r2/r1 \leqq 5.0$".

Chopper circuits for supplying positive potential and chopper circuits for supplying negative potential can be equally used as. a d.c. power supply as long as the relationship of potential between the electrodes and the conductor above described is satisfied. Moreover, the d.c. power supply is not limited to the chopper circuit, but may be a switching power supply of different types.

In accordance with the discharge lamp lighting device and the lighting method of the present invention, a conductor is provided so as to surround the electrodes of the discharge lamp, the conductor having a potential higher than the average potentials of the electrodes of the discharge lamp. As a result, the present invention at least provides the advantage of suppressing reaction between the material composing the arc tube (of the discharge lamp) and the light-emitting metals, thereby prolonging the life of the discharge lamp.

Various other modifications will be apparent to and can be readily made by those skilled in the art without departing from the scope and spirit of this invention. Accordingly, it is not intended that the scope of the claims appended hereto be limited to the description as set forth herein, but rather that the claims be broadly construed.

What is claimed is:

1. A discharge lamp lighting device comprising:

a discharge lamp including an arc tube with an electrode provided inside the arc tube, and an outer tube surrounding the arc tube; and a lighting circuit for lighting the discharge lamp, the lighting circuit being connected to the discharge lamp, wherein the discharge lamp includes a conductor disposed on a surface of the outer tube at least partially surrounding the electrode, and the lighting circuit applies a potential to the conductor that is higher than an average potential of the electrode to generate an electric field from the conductor to the arc tube.

2. A discharge lamp lighting device according to claim 1, wherein the discharge lamp includes an arc tube having two or more electrodes provided inside the arc tube, a light-emitting gas being sealed in the arc tube, and the conductor included in the discharge lamp is disposed on a surface of the arc tube.

3. A discharge lamp lighting device according to claim 2, wherein the conductor is a light-transmitting film.

4. A discharge lamp lighting device according to claim 1, wherein the discharge lamp includes two or more electrodes provided inside the arc tube and a light-emitting gas being sealed in the arc tube.

5. A discharge lamp lighting device according to claim 4, wherein the ratio of a diameter of the outer tube to a diameter of the arc tube is 5.0 or less.

6. A discharge lamp lighting device according to claim 5, wherein the conductor includes at least one straight stripe-shaped film extending in parallel to an axial direction of the outer tube.

7. A discharge lamp lighting device according to claim 6, wherein the conductor includes a plurality of said straight stripe-shaped films, the straight stripe-shaped films being disposed at equal intervals and at least partially surrounding the outer tube.

8. A discharge lamp lighting device according to claim 5, wherein the conductor is a helical stripe-shaped film disposed so as to at least partially surround the outer tube.

9. A discharge lamp lighting device according to claim 4, wherein the conductor is a light-transmitting film.

10. A discharge lamp lighting device according to claim 9, wherein the conductor includes at least one straight film extending in parallel to an axial direction of the outer tube.

11. A discharge lamp lighting device according to claim 10, wherein the conductor includes a plurality of said straight stripe-shaped films, the straight stripe-shaped films being disposed at equal intervals and at least partially surrounding the outer tube.

12. A discharge lamp lighting device according to claim 9, wherein the conductor is a helical stripe-shaped film disposed so as to at least partially surround the outer tube.

13. A discharge lamp lighting device according to claim 4, wherein the conductor is disposed in an upper portion of the outer tube.

14. A discharge lamp lighting device according to claim 13, wherein the conductor includes at least one straight stripe-shaped film extending in parallel to an axial direction of the outer tube.

15. A discharge lamp lighting device according to claim 4, wherein the conductor is disposed on an inner surface of the outer tube.

16. A discharge lamp lighting device according to claim 15, wherein the conductor includes at least one straight stripe-shaped film extending in parallel to an axial direction of the outer tube.

17. A discharge lamp lighting device according to claim 16, wherein the conductor includes a plurality of said straight stripe-shaped films, the straight stripe-shaped films being disposed at equal intervals and at least partially surrounding the outer tube.

18. A discharge lamp lighting device according to claim 15, wherein the conductor is a helical stripe-shaped film disposed so as to at least partially surround the outer tube.

19. A discharge lamp lighting device according to claim 1, wherein the conductor has a potential equal to a ground potential.

20. A discharge lamp lighting device according to claim 1, wherein the lighting circuit further includes an auxiliary power supply for providing a potential for the conductor that is higher than a maximum potential of the electrode.

21. A discharge lamp lighting device according to claim 1, wherein the conductor is disposed on an inner surface of the outer tube.

22. A discharge lamp lighting device according to claim 1, wherein the conductor is disposed on an outer surface of the outer tube.

23. A discharge lamp lighting device according to claim 1, wherein the conductor is limited primarily to a portion of the surface of the outer tube above an arc which occurs in the arc tube during operation.

24. A discharge lamp lighting device according to claim 1, wherein the electric field is operative to reduce devitrification due to reactions between light-emitting metals and the arc tube while reducing loss of light-emitting metals due to diffusion of the metal ions.

* * * * *